US005442898A

United States Patent [19]

Gabree et al.

[11] Patent Number: 5,442,898

[45] Date of Patent: Aug. 22, 1995

[54] METHOD AND APPARATUS FOR OPENING, FILLING AND CLOSING A PREMADE WICKETED BAG

[75] Inventors: Joseph P. Gabree, Duluth; Steve W. Campbell, Tucker; Charles Hood, Lilburn, all of Ga.

[73] Assignee: A.P.M. Distributing, Inc., Norcross, Ga.

[21] Appl. No.: 131,715

[22] Filed: Oct. 5, 1993

[51] Int. Cl.[6] ..... B65B 1/22; B65B 43/36

[52] U.S. Cl. ..... 53/459; 53/385.1; 53/437; 53/468; 53/525; 53/572

[58] Field of Search ..... 53/468, 469, 459, 572, 53/571, 570, 385.1, 437, 525

[56] References Cited

U.S. PATENT DOCUMENTS

| | | | |
|---|---|---|---|
| 1,892,148 | 12/1932 | Hohl | 53/385.1 X |
| 3,228,173 | 1/1966 | Reynolds | 53/385.1 |
| 3,468,100 | 9/1969 | Rubel | 53/385.1 X |
| 3,668,818 | 6/1972 | Holmes . | |
| 3,727,374 | 4/1973 | Williams | 53/385.1 X |
| 3,807,122 | 4/1974 | Kihnke et al. | 53/385.1 X |
| 3,822,527 | 7/1974 | Germunson et al. | 53/385.1 X |
| 3,897,676 | 8/1975 | Membrino | 53/385.1 X |
| 4,171,602 | 10/1979 | Richardson | 53/67 |
| 4,172,349 | 10/1979 | Lipes | 53/572 X |
| 4,250,694 | 2/1981 | Rochman | 53/572 |
| 4,253,292 | 3/1981 | Lipes | 53/572 X |
| 4,999,969 | 3/1991 | Holmes | 53/138.3 |
| 5,001,889 | 3/1991 | Mueller | 53/502 |
| 5,079,897 | 1/1992 | Muller | 53/385.1 X |
| 5,177,939 | 1/1993 | Lipes | 53/572 |

*Primary Examiner*—James F. Coan
*Attorney, Agent, or Firm*—Jones & Askew

[57] ABSTRACT

An automated bagging system with a device that performs the dual functions of opening a bag and then supporting the bag as the bag is filled with a product. A supply of air is guided into a wicketed bag by a pivotable plate in a first position. After the plate guides the air into the bag, thus fully opening the bag, the plate moves into a second position. In this second position, the plate clamps a side of the bag opposite the wicket between the plate and a stop plate. The plate and the stop plate, in combination with a clamp on the wicket side of the bag, effectively keep the bag open after the initial supply of air ends to allow the bag to receive a dispensed product. Additionally, the plate, stop plate and clamp support the bag. This support prevents the bag from being torn away from the wicket from the force of the product on the sides and bottom of the bag as the product falls into the bag. Once the bag is filled with the product, a process slide with a jaw-like grip grasps the side of the bag that is clamped between the plate and the stop plate. As the plate releases the bag, the process slide tears the bag from the wicket. The slide guides the bag to a bag closer that effectively contains the product within the bag.

25 Claims, 9 Drawing Sheets

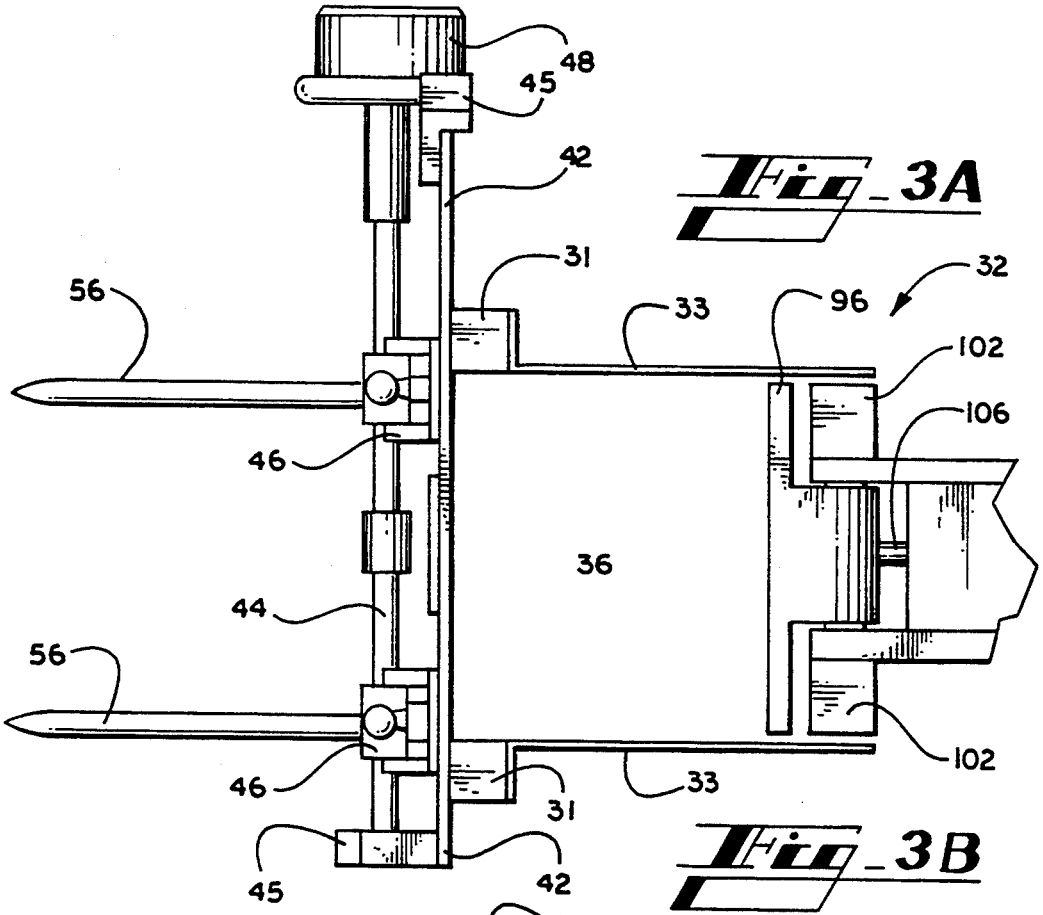
Fig_3A
Fig_3B
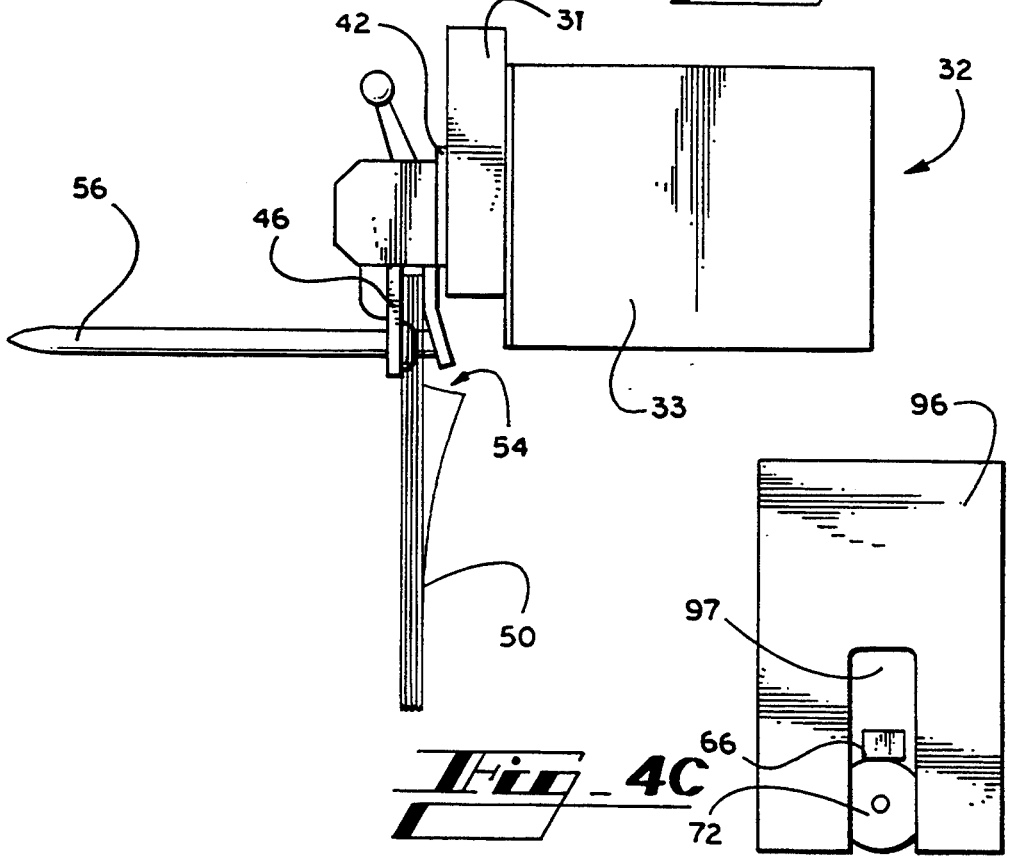
Fig_4C

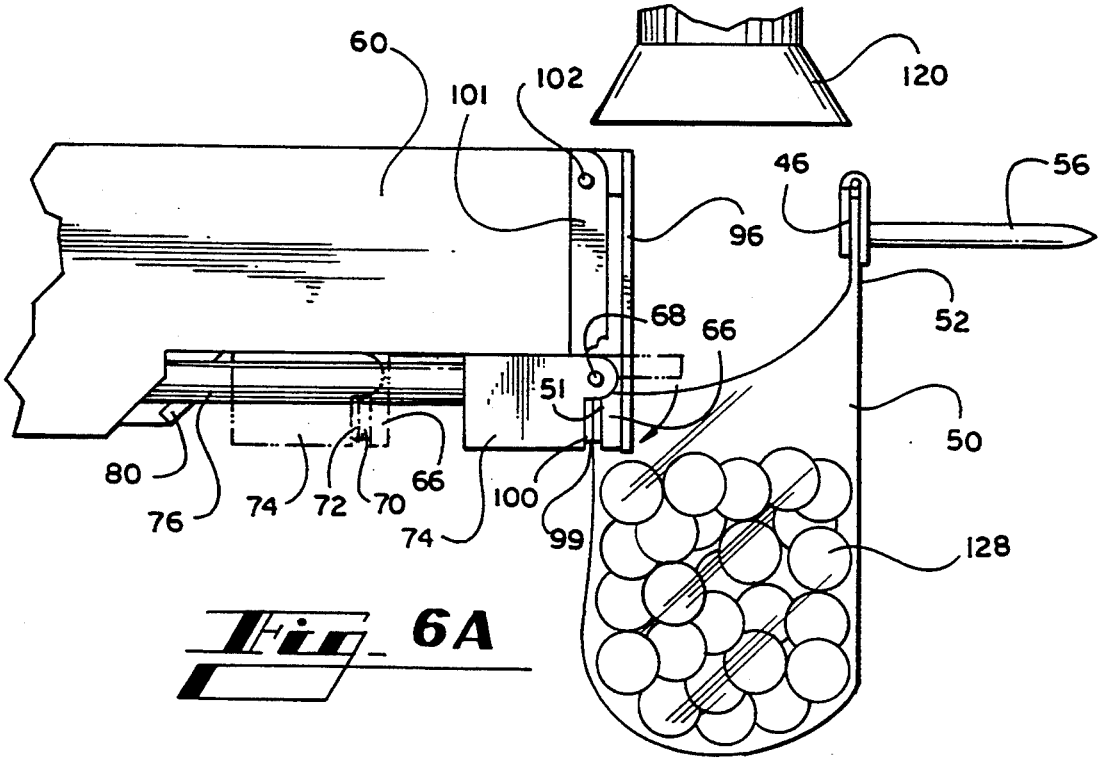
Fig. 6A
Fig. 6B
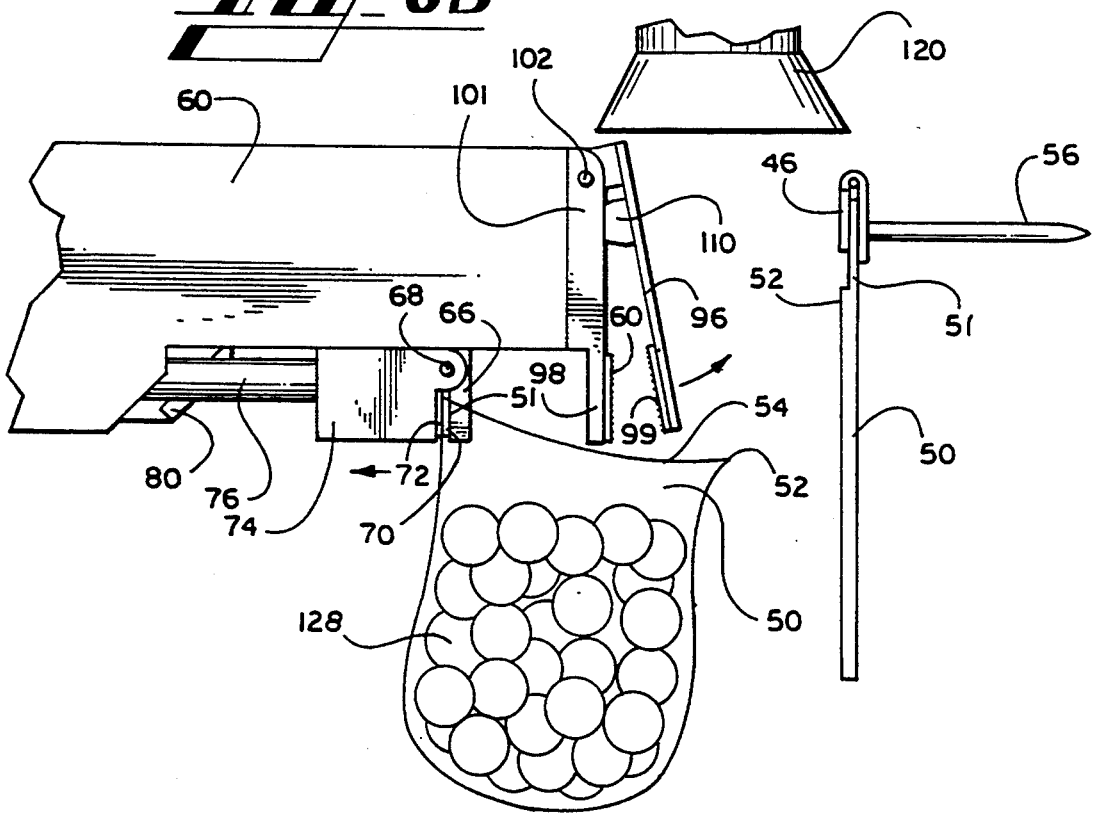

METHOD AND APPARATUS FOR OPENING, FILLING AND CLOSING A PREMADE WICKETED BAG

TECHNICAL FIELD

The present invention relates generally to automatic bagging systems. More specifically, the present invention relates to an apparatus and method for opening a premade wicketed bag in which a rear bag plate guides air into the bag and then holds the bag open as the bag is filled with a product.

BACKGROUND OF THE INVENTION

A wide variety of automated bagging systems are currently in use for packaging oranges, apples, potatoes, ice and other similar types of produce and fungible goods. These systems boost efficiency and productivity by making possible the handling of large quantities of a product in an orderly fashion while at the same time minimizing labor costs.

Many bagging systems use bags made from petroleum based plastics such as polyurethane or polyethylene. These bags often are mounted in large numbers on wickets, clamps or other devices that allow the bagging system to access the bags in an assembly-line manner. A typical bagging system pulls bags off one at a time and opens each bag individually. The system then fills the bag with a product. The product is supplied by a dispensing mechanism typically consisting of a conveyor belt supply that carries the product from a remote location to a chute that funnels the product into the bag. A tying mechanism then closes the bag and removes the bag to make room for the next bag off of the wicket. The process is then repeated with the next bag.

One example of this type of automatic bagger is discussed in Germunson et al., U.S. Pat. No. 3,822,527. Germunson relates to an automated bagging system that opens standard wicketed bags by an initial blast of air followed by the insertion of an expandable scoop. After the initial blast of high pressure air, the expandable scoop enters the bag and supports the bag edge opposite the wicketed bag stand to provide a wide opening for material, such as fruit, to enter the open bag. The scoop includes a pair of scoop halves that are pivoted at their upper ends on a bracket. When the scoop halves are collapsed, they fit easily inside the opened top of the bag. When expanded, the scoop halves support and hold the bag open as well as guide articles into the opened bag. A pair of releasable clamps hold the bag edge corresponding to the wicket side of the bag. These clamps support the bag as articles are introduced into the bag. Only the scoop supports the bag opposite the wicketed side. However, the scoop tends to tear the bags upon withdrawal of the scoop. This tearing may result in lost product and increased system down time.

Several drawbacks exist in prior automated bagging systems. First, some systems carry out many steps, requiring complex mechanical components in conjunction with sophisticated computer control technology. More particularly, bagging systems often use complicated systems to open, clamp and hold a bag in an open position. Each mechanical component often serves only a single functional purpose. Second, the air supply usually does not adequately direct the air into the bag. Because of wicketed mounting and thin membrane-like construction, bags have a proclivity to stick to each other. As a result, the air in prior systems often blows into the top or the side of the bag at an angle close to the horizontal, allowing the air stream to catch the interior lip of the bag. The bag thus opens only partially at the top and often remains closed at the bottom. Third, bag clamping mechanisms cause problems in current and prior systems. The clamping mechanisms act to tear the bags or to not give enough support to the bags as the product is dispensed into the bags. The downward force of the product entering the bag from the dispensing mechanism tends to pull the bag from the clamp. These clamps also tend to partially block the opening of the bag as they support the bag. This partial blockage makes the opening to the bags smaller and interferes with the dispensing of the goods.

The inventors have discovered, through the nature of their work and their profession, that the presently utilized systems and methods for opening, supporting and filling premade wicketed bags in an automated bagging system are undesirable.

Thus, there is a need for an improved automated bagging system with multi-functional parts.

There is a further need to provide an automated bagging system that more accurately guides air into the bag to be filled so that the bag becomes fully expanded before filling.

There is a further need to provide an automated bagging system that utilizes a simple clamping device that supports, while at the same time does not tear, the bags.

There is a further need to provide an automated bagging system with a clamp for support of the bag during the time it is being filled that minimizes blockage of the bag opening.

SUMMARY OF THE INVENTION

As will be seen, the present invention overcomes these and other problems associated with the prior art. Stated generally, the present invention provides an improved automated bagging system with multi-functional parts. Further, the automated bagging system of the present invention more accurately guides air into the bag to be filled so that the bag becomes fully expanded before filling. The automated bagging system of the present invention utilizes an uncomplicated device that supports, but does not tear, the bags. The bagging system also provides support for the bag during the time it is being filled that minimizes blockage of the bag opening.

Stated more specifically, in a first aspect, the present invention comprises at least one bag, an air supply, a horizontally pivotable plate and an actuator mechanism. The bag has a mouth and a first side attached to a holding mechanism. In a first position, the horizontally pivotable plate extends downwardly from a pivot at an angle to an edge of the plate that is spaced apart from the pivot and is adjacent to the bag. In this first position, the plate is oriented to guide air from the air supply into the mouth of the bag. The plate is movable to a second position where the plate extends into the bag to clear the mouth of the bag and to support a second side of the bag. The actuator mechanism moves the plate from the first position to the second position.

In the preferred embodiment of the present invention, the automatic bagging system further comprises a stop, a bag clamp, a process slide with a gripping member, a bag closer, a product supply with an agitator and a conveyor. The stop allows the second side of the bag to be clamped between the plate and the stop when the plate is in its second position. The bag clamp clamps the first side of the bag between the bag clamp and the remaining wicketed bags to provide further support to the bag. The gripping member grips and tears away the bag after the bag is filled with the product. The process slide comprises an air cylinder, a linear bearing, a shaft and a solenoid valve. The bag closer is operative to close the bag after the bag is filled with the product. The product supply operates to fill the bag with the product. An agitator keeps the supply from jamming with the product as the product is dispensed into the bag. A conveyor moves the bag, after the bag is filled with the product, from the product supply to the bag closer. The conveyor runs in synchronous fashion with the plate and provides further support to the bag while the product supply fills the bag with the product. Further, the air supply is a fan. The holding mechanism is a wicket capable of holding a plurality of bags. The clamping sides of both the plate and the stop have a plastic coating to further minimize tearing of the bag.

In a second aspect, the present invention comprises a method for automatically bagging a product. This method provides at least one premade wicketed bag with an opening. A flow of air is directed toward the opening in the bag. The air is directed by positioning a horizontally pivotable plate extendible downwardly from a pivot at an angle to a first position. In this first position, the far edge of the plate is adjacent to the bags to guide air from the air supply into one of the bags. The plate next is moved to its second position where that the plate clamps the bag on a first side of the bag so that the bag is open to receive a product. Preferably, a plurality of wicketed bags is provided, and the process can be repeated for each bag on the wicket.

In the preferred embodiment of this second aspect, the plate is moved to a second position so that the plate clamps the bag between the plate and a stop on a non-wicketed side of the bag. A second side of the bag is clamped with a bag clamp. This second side is the wicketed side of the bag. The flow of air is directed from a fan. Further, the product is agitated as it is dispensed to prevent the product from becoming jammed. Finally, the bag containing the dispensed product is conveyed to a location where the bag is closed. The conveyance of the bag runs in synchronous fashion with the pivotable plate as the plate rotates between its first and second positions.

In a third aspect, the present invention comprises a plurality of bags, an air blower, a front bag clamp, a rear bag clamp, a dispensing mechanism, a process slide, and a bag closer. The plurality of bags is located on a wicketed bag supply. The air blower initially opens one bag of the plurality of bags. The front bag clamp holds a front portion of the bag as the bag is opened, while the rear bag clamp secures a rear portion of the bag. The rear bag clamp is movably pivotable to a first position to guide air from the air blower into the bag. The rear bag clamp is also movably pivotable to a second position to secure the rear portion of the bag to a stop. The dispensing mechanism supplies a product to the open bag. A gripping member on the process slide grasps the bag as the process slide pulls the bag from the wicketed bag supply. The bag closer closes the bag as the process slide pulls the bag from the wicketed bag supply.

In a fourth aspect, the present invention comprises a method of sequentially opening, filling and closing a plurality of bags. In this method, a front portion of a bag from a plurality of bags is clamped. A rear clamp, extendible downwardly from a pivot at an angle into the bag, is pivotably rotated into a first position to guide a supply of air into the bag to open the bag. As air is being blown into the bag, the rear clamp is pivotably rotated into a second position. In this second position, the rear clamp secures the bag between the rear clamp and a stop. Next, a product is dispensed into the bag. After the product is dispensed into the bag, the bag is closed to effectively contain the product within the bag.

In a fifth aspect, the present invention comprises an apparatus for opening a bag in an automatic bagging system. The apparatus comprises a plurality of bags, a supply of air and a clamping plate. The supply of air opens each bag of the plurality of bags. The clamping plate is pivotably moveable between a first and a second position. In the first position, the plate guides air from the supply of air into a bag to fully open the bag. In the second position, the plate maintains the bag in an open position as the bag is filled with the product.

A sixth aspect of the present invention comprises a method for preparing a premade bag to be filled with a dispensed product for use in an automatic bagging system. Air from an air supply is provided. A plate is pivotably adjusted to a first position to guide air from the air supply into the bag. The air opens the bag to enable the bag to receive the dispensed product. After the plate is pivotably adjusted to the first position, the plate is next pivotably adjusted to a second position to clamp the bag between the plate and a stop so as to hold the bag open as the product is dispensed into the bag.

Other objects, features and advantages of the present invention will become apparent upon reading the following specification, when taken into conjunction with the drawings and the appended claims.

BRIEF DESCRIPTION OF THE DRAWINGS

FIG. 3A is a top view of a wicketed bag supply of the present invention.

FIG. 3B is a side view of the wicketed bag supply of FIG. 3A.

FIG. 4C is a front view of the pivotable plate apparatus of the bagging mechanism.

FIG. 6A–6D are views showing steps involved in the jaw mechanism gripping the bag filled with dispensed product and tearing away the bag from the wicket.

DETAILED DESCRIPTION OF THE PREFERRED EMBODIMENT

Figure 1:
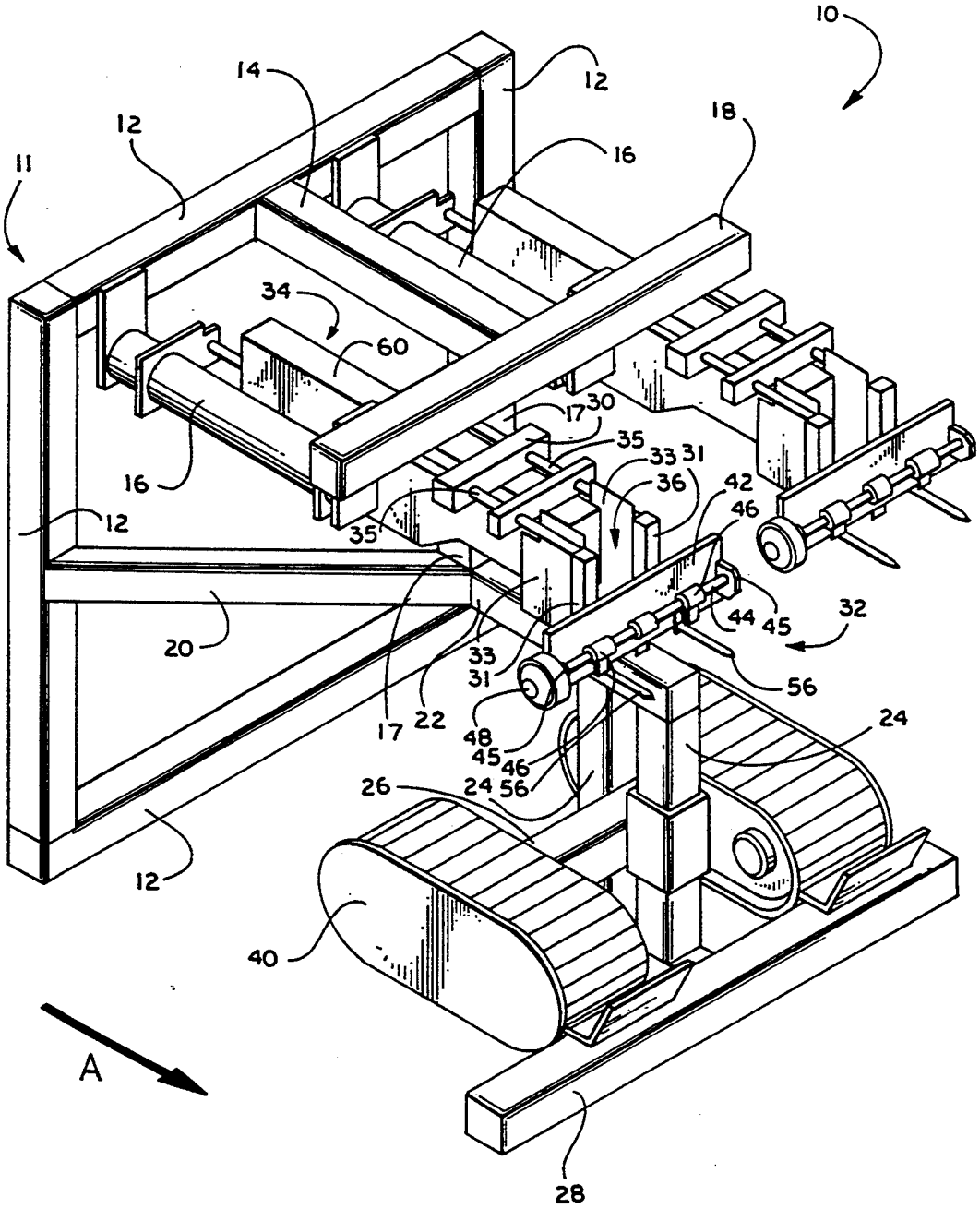
FIG. 1 a pictorial view of a bagging system incorporating the pivotable plate apparatus according to the preferred embodiment of the present invention.
Figure 2:
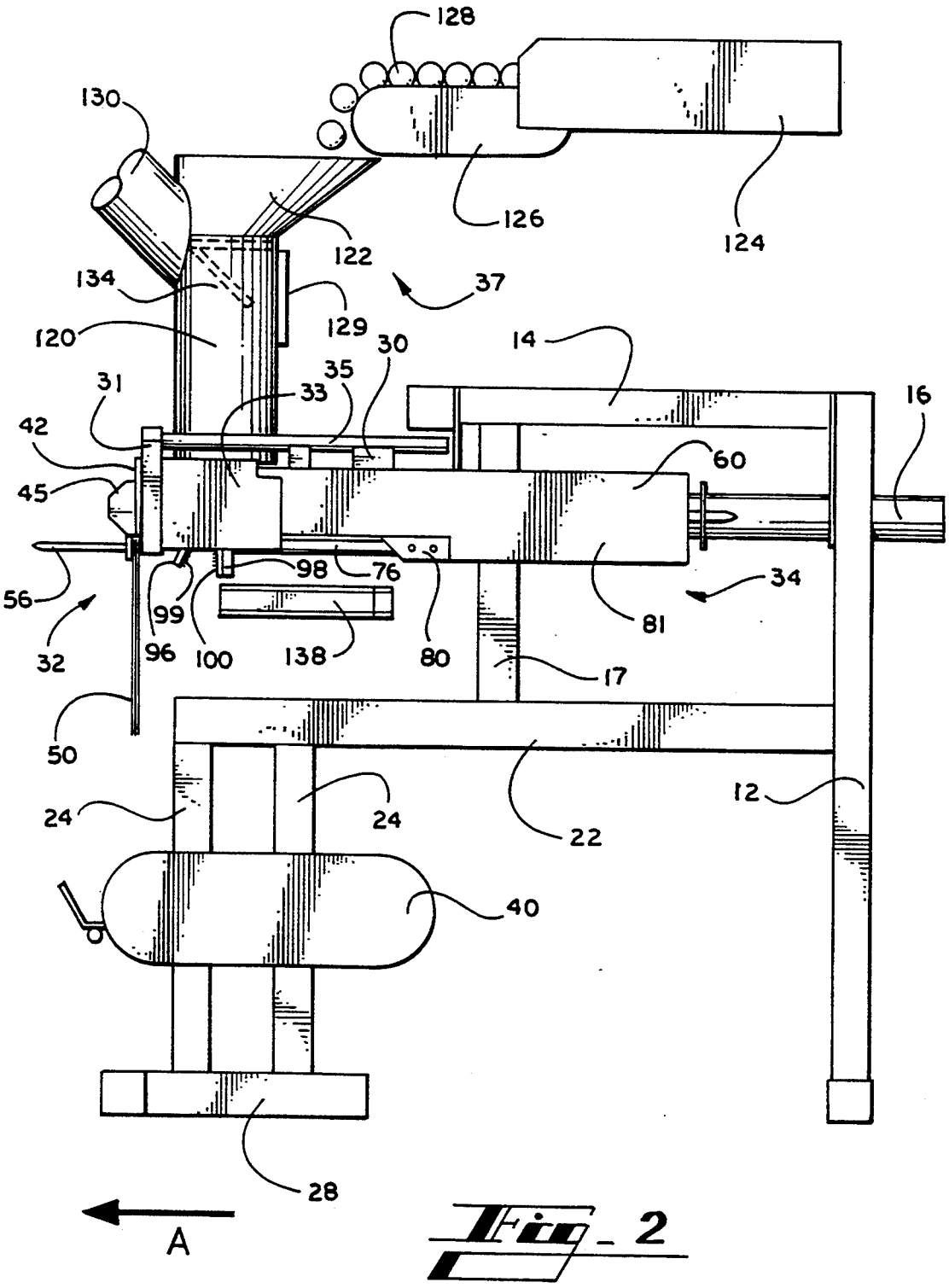
FIG. 2 is a side elevational view of the bagging system of FIG. 1.

The automated bagging system 10, as shown in FIG. 1, is comprised of four main subassemblies: a support base subassembly 11, a wicketed bag supply subassembly 32, a bagging mechanism subassembly 34, and a product supply subassembly 37 shown in FIG. 2, FIG. 1 shows a system configuration in which two automated bagging systems operate simultaneously with one another. It should be understood that, although reference will be made throughout the disclosure to the structure and function of only one of the systems, the structure and function of both systems are identical.

Referring now in detail to the drawings, FIG. 1 shows the automated bagging system 10 mounted on a support base subassembly 11, which includes an upstanding rear rectangular frame 12. Extending in a forward direction, indicated generally by Arrow A, from the top center of the rectangular rear frame 12 toward the front of the system is an upper longitudinal beam 14. A pair of cylindrical beams 16 extends forward in parallel, and in a horizontal plane slightly below the horizontal plane in which upper longitudinal beam 14 is located, on either side of the longitudinal beam 14. A transverse beam 18 is supportively affixed to the end of longitudinal beam 14, while the cylindrical beams 16 extend from the frame 12 to the transverse beam 18 with the longitudinal member 14. Angled braces 20 are located in a horizontal plane spaced below cylindrical beams 16 and extend, one from each side of the frame 12, forward at an acute angle, meeting at a lower longitudinal beam 22. Lower longitudinal beam 22 extends forwardly from the intersection of the angled braces 20. A vertical beam 17 extends from the intersection of lower longitudinal beam 22 and angled braces 20 to the upper beam 14. The vertical beam 17, upper longitudinal beam 14 and cylindrical beams 16 provide support to the transverse beam 18. A pair of front vertical beams 24 extend in parallel vertically downwardly from the front end of the lower longitudinal beam 22 and brace a transverse conveyor support beam 26. A transverse beam 28 attached to the bottom of the front vertical beams 24 acts as a foot to stabilize the frame 11.

Attached to the transverse beam 18 and one of the beams 16 is a bagging mechanism support 30. The bagging mechanism support 30 includes a pair of rods 35 which extend in a direction substantially parallel to longitudinal beam 14 and supports both the wicketed bag supply subassembly 32 and the bagging mechanism subassembly 34. The wicketed bag supply subassembly 32 is connected to a pair of vertical bars 31 located at the front end of the bagging mechanism support 30, while the bagging mechanism subassembly 34 is attached between the parallel rods 35 of the bagging mechanism support 30. Guide plates 33 are also attached to parallel rods 35 and enclose the space behind the vertical bars 31. The combination of the bagging mechanism support 30, the wicketed bag supply subassembly 32, the bagging mechanism subassembly 34 and the guide plates 33 defines a channel 36 above which the product supply subassembly 37 is positioned. As shown in FIG. 2, a conveyor 40 is positioned beneath each product supply subassembly 37 for reasons set forth in detail below. Each conveyor 40 is attached to an end of the beam 26.

Turning now to the structure of the wicketed bag supply subassembly 32 as shown in FIGS. 3A and 3B, the subassembly 32 is secured to the vertical bars 31 in front of guide plates 33 at the front ends of parallel rods 35 of the bagging mechanism support 30 through a bag supply clamp plate 42. A clamp drive shaft 44 is rotatably mounted adjacent to the front side of the bag supply clamp plate 42 through bearing plates 45. A pair of bag clamps 46 is positioned on the shaft 44. Through the control of a variable tension controller 48, the bag clamps 46 secure a plurality of bags 50 between the bag clamps 46 and the bag supply clamp plate 42. Wickets 56 are attached to the wicketed bag supply clamp plate 42 and extend forward in the direction indicated by Arrow A. The bags 50 are placed in position on the wickets 56 in a conventional manner so the mouths 54 of the bags 50 can be opened and filled with a product as shown and described below.

Figure 4A:
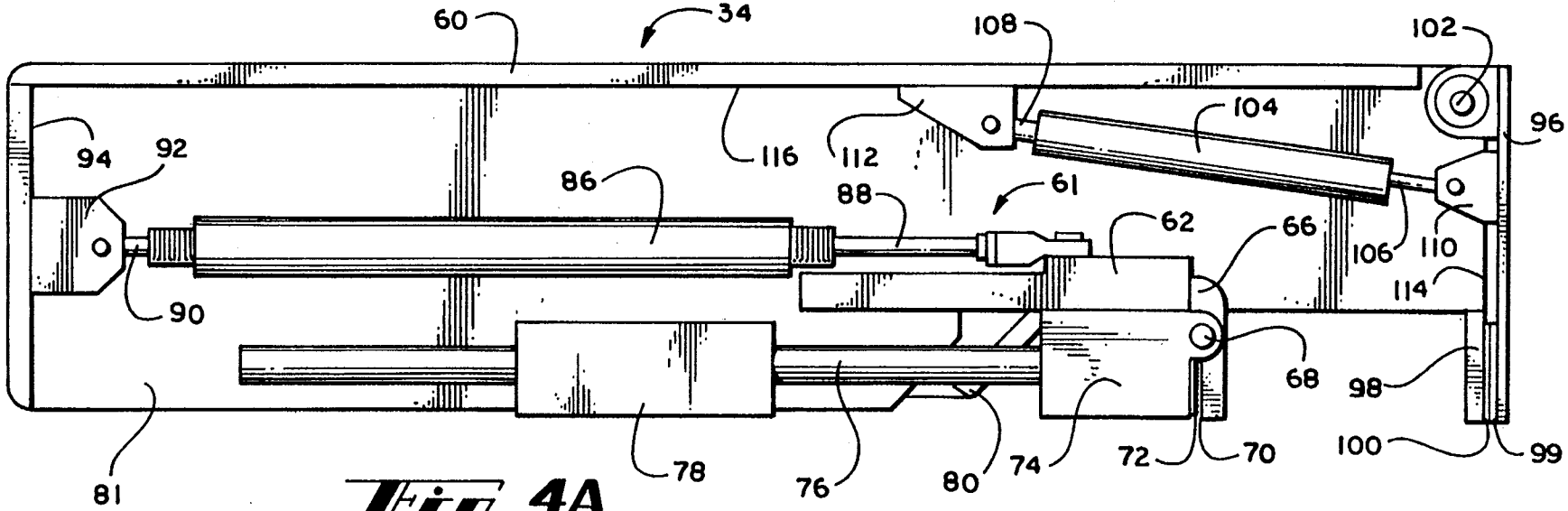
FIG. 4A is a right side view Of a bagging mechanism of the present invention with one side of the outer casing removed.
Figure 4B:
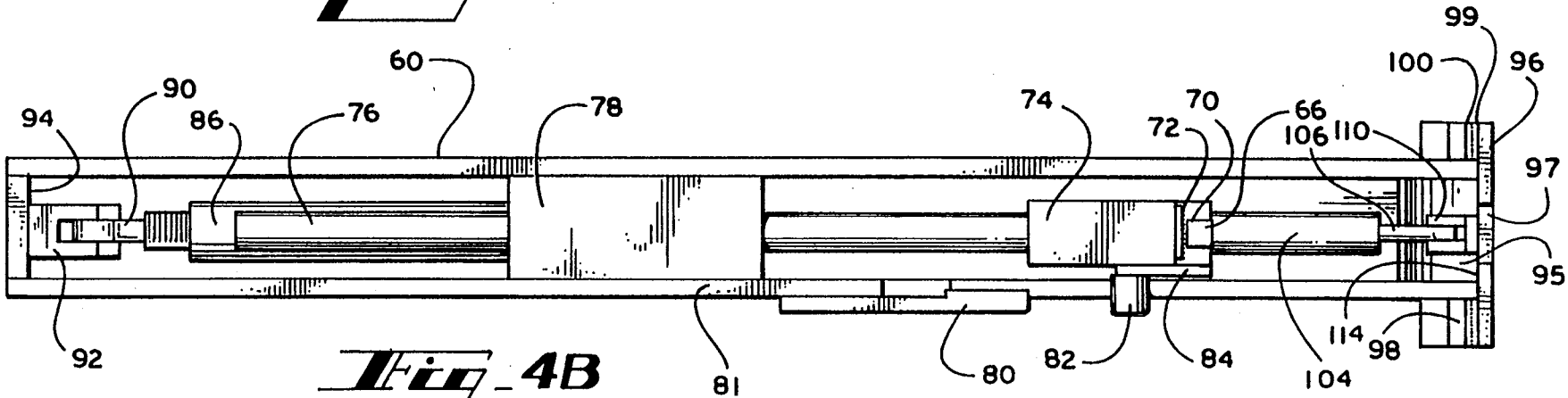
FIG. 4B is a bottom view of the bagging mechanism with the bottom of the outer casing removed.
Figure 4D:
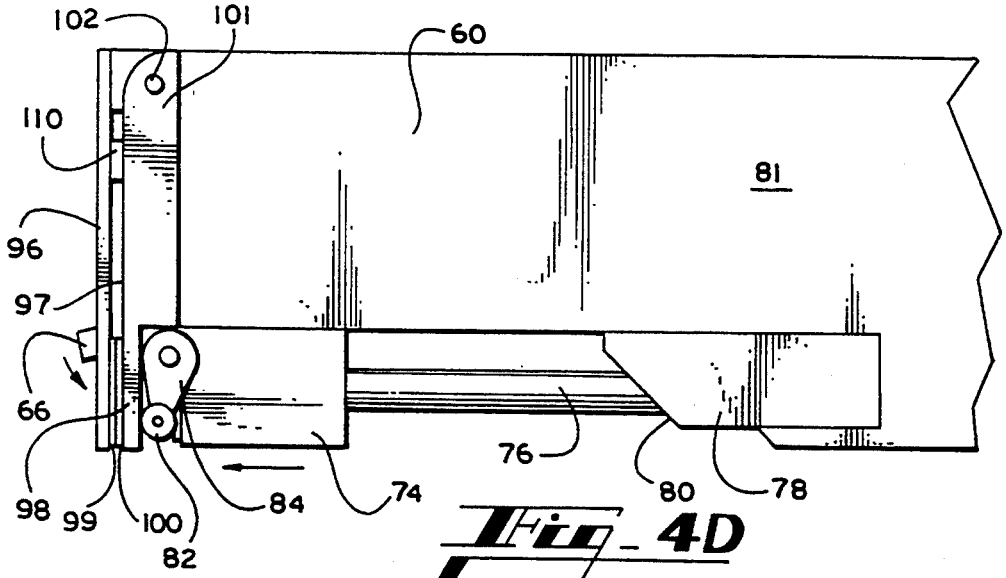
FIG. 4D is a partial left side view of the bagging mechanism with its jaw mechanism in a forward position.

Turning next to the structure of the bagging mechanism subassembly 34, a bagging mechanism casing 60 is supportively connected to bagging member support 30. FIG. 4A shows a view of the bagging mechanism subassembly 34 with a side of the casing 60 removed. Mounted within the casing 60 is a process slide 61 for grasping and pulling a bag 50 rearwardly in a manner set forth in detail below. On this process slide 61, a jaw mechanism casing 62 is positioned adjacent to the bottom of the casing 60. As shown in FIG. 4F, the jaw mechanism casing 62 contains an air cylinder 64 and a piston rod 65 extending therefrom. Preferably, this cylinder is a Festo DSN-16-25-P air cylinder. This cylinder 64 is constantly pressurized and acts as a spring in moving the gripping jaw 66 between its opened and closed positions. In addition, the air cylinder 64, as with other air cylinders present in the bagging mechanism subassembly 34 and described in detail below, is operated by a solenoid valve in a pneumatic circuit (not shown). This solenoid valve in turn is controlled by control technology described in further detail below. The piston rod 65 is rotatably connected to a gripping jaw 66 by a hinge 67. The gripping jaw 66 is mounted to a jaw body 74, positioned beneath the jaw casing 62, by a pivot pin 68 spaced between the hinge 67 and the extending end of the jaw 66. This connection allows the gripping jaw 66 to move between an open and a closed position, as shown in phantom in FIG. 4F and as will be set forth in detail below. To facilitate the gripping of a bag 50 by the gripping jaw 66, the clamping surface of the gripping jaw 66 and the front face of jaw body 74 are lined with rubber or plastic grip teeth 70 and 72, respectively.

Returning to FIG. 4A, the jaw body 74 is attached to a guide shaft 76. The guide shaft 76 is positioned by a linear bearing 78 to support the jaw body 74 for movement in a bi-directional path relative to the wicketed bag supply subassembly 32. Preferably, this bearing 78 is a Thomson TWN linear bearing. The jaw body 74 and jaw mechanism casing 62 are moved forward and backward along the guide shaft 76 by an air cylinder 86. This air cylinder 86 is preferably a Festo DSN-1-10-P air cylinder. The air cylinder 86 is connected to the jaw mechanism casing 62 by a piston rod 88 and pivotably is connected by a shaft 90 to a yoke 92 attached to a rear wall 94 of the casing 60.

A cam surface 80 is defined by a cut-out in a left side wall 81 of the casing 60. The cam surface 80 angles downwardly from front to back. A cam follower 84 is attached to the gripping jaw 66 through the outer side of the jaw body 74 by pin 67. A roller 82 is rotatably mounted to the extending end of the cam follower 84.

Figure 4E:
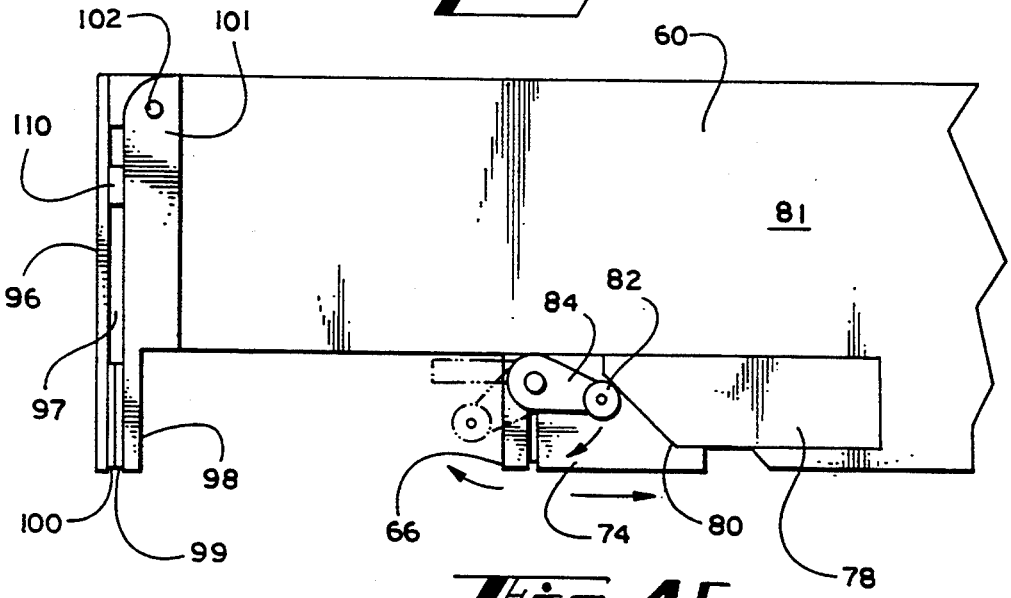
FIG. 4E is a left side view of the bagging mechanism in a rearward position with the jaw mechanism gripping jaw shown in a closed position and the open position being shown in dashed lines.
Figure 4F:
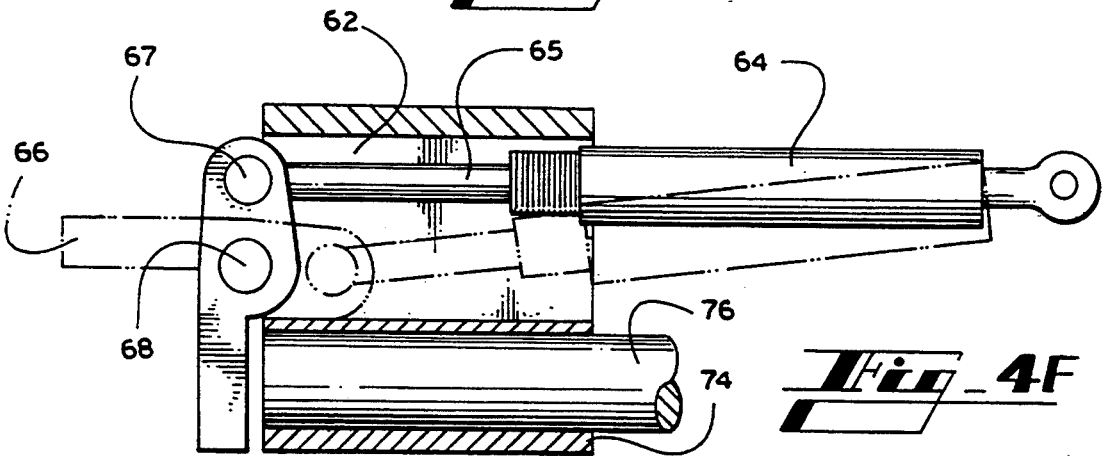
FIG. 4F is a partial side view of the jaw mechanism, with its housing partly removed to show interior detail

As the jaw body 74 is moved away from the wicketed bag supply subassembly 32 and toward the linear bearing 78 by air cylinder 86, the gripping jaw 66 is cocked into an open position by contact between the cam surface 80 and the roller 82 of the cam follower 84, as illustrated in FIG. 4E.

A stop plate 98 is located at the front wall 114 of the bagging mechanism casing 60. The stop plate 98 is fixedly attached to the bagging mechanism casing 60 by a stop jacket 101, shown in FIG. 4D. The stop plate 98 extends vertically below the bottom surface of the bagging mechanism 34 along its width, and defines a passageway 95 through which the gripping jaw 66 and the jaw body 74 pass. A pivotable plate 96 is pivotably mounted about pivot hinge 102 which extends across the top front comer of the bagging mechanism casing 60. The rotation of the pivotable plate 96 is controlled by an air cylinder 104, shown in FIG. 4A, that is connected to the pivotable plate 96 by a piston rod 106 that is pivotably connected to a yoke 110 attached to the plate 96. This air cylinder 104 preferably is a Festo DSN 1-2-P air cylinder. At its end opposite the pivotable plate 96, the air cylinder 104 is connected to a top wall 116 of the bagging mechanism casing 60 by a rotatable connection between a rigid shaft 108 and a yoke 112 attached to the top wall 116. As shown in FIG. 4C, the plate 96 contains an opening 97 in the path of gripping jaw 66 through which the gripping jaw 66 is moved by the air cylinder 86 for reasons set forth in detail below. Pivotable plate 96 and stop plate 98 both are coated with rubber teeth 99 and 100 similar to the rubber teeth 70 and 72 of gripping jaw 66 and jaw body 74. Alternatively, these teeth could be made of plastic or of any other substance capable of securing the bag 50 without tearing it.

Turning next to the product supply subassembly 37, as shown in FIG. 2, a duct 120 is positioned directly above the channel 36 defined by the combination of the bagging mechanism support 30, wicketed bag supply subassembly 32, bagging mechanism subassembly 34 and guide plates 33. A receiving funnel 122 is attached to the top of the duct 120 and is positioned to receive large quantities of a product 128 as the product 128 is dispensed from a feed conveyor 126 into the receiving funnel 122. The product 128 is supplied to the receiving funnel 122 from a conventional product supply mechanism 124. An agitator 129 is connected to the funnel 122 to prevent the funnel 122 and the duct 120 from jamming with the product 128, particularly when the product consists of large individual pieces of produce such as potatoes or apples. The product supply 124 usually is located in an area remote to the bagging system 10. Consequently, the product 128 is transported from the remote product supply 124 to the receiving funnel 122 by the conveyor 126. An air supply duct 130 also is connected at an angle to the side of the duct 120. A fan at a remote location (not shown) supplies intermittent blasts of air through the duct 120 into bags 50 for reasons set forth in detail below. Alternatively, an expansion and contraction mechanism such as a bellows could supply the intermittent blasts of air.

Figure 5A:
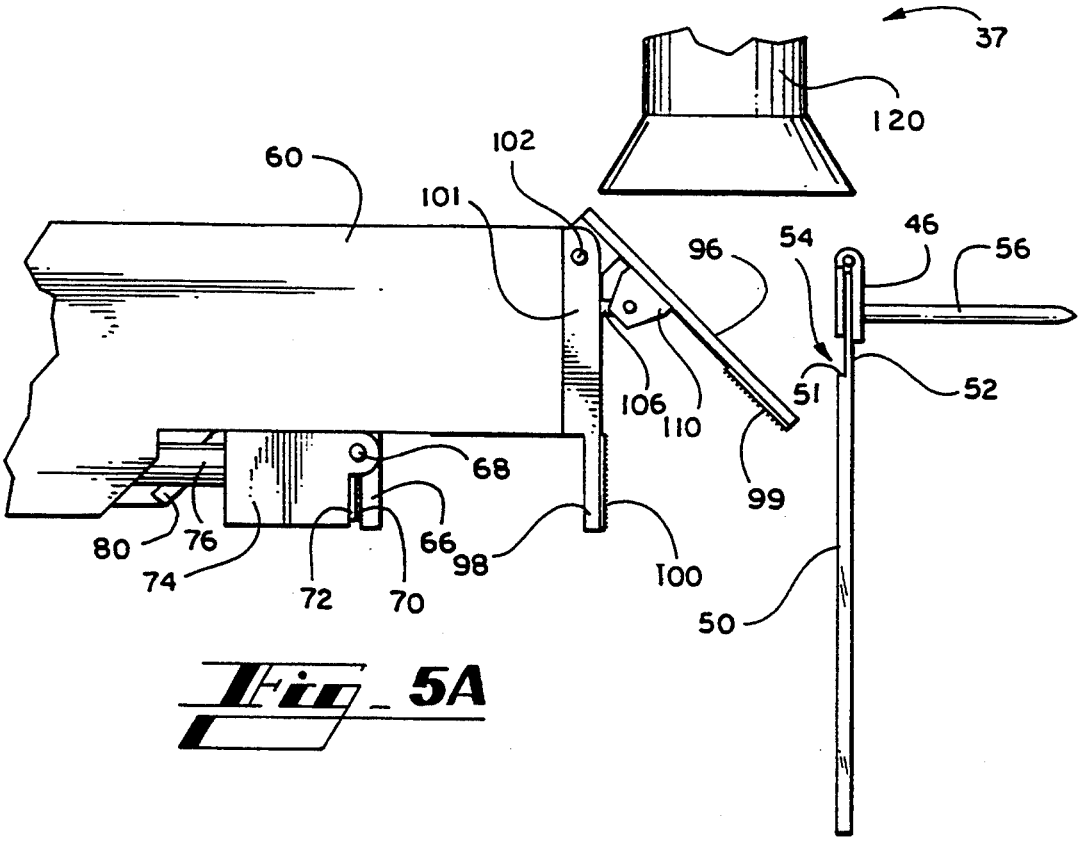
FIGS. 5A–5D are views illustrating the steps involved in the pivotable plate Opening and clamping a premade wicketed bag to prepare the bag to receive a dispensed product.
Figure 5B:
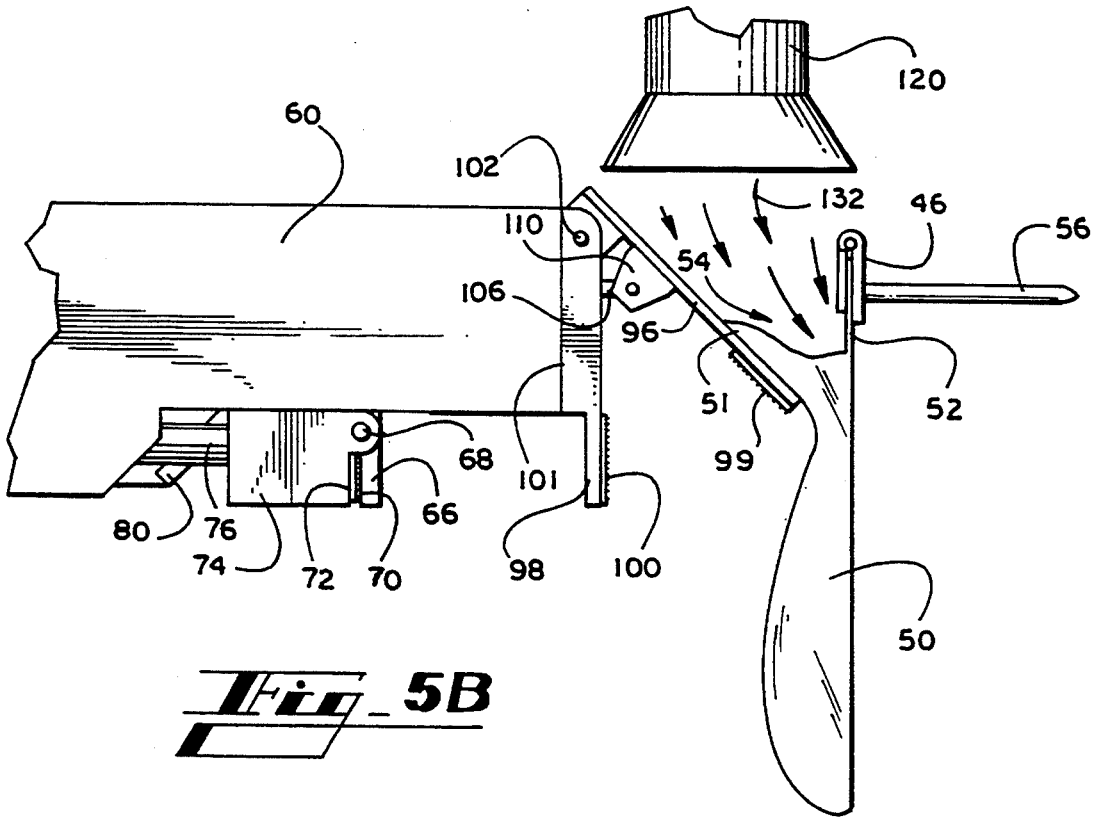
Figure 5C:
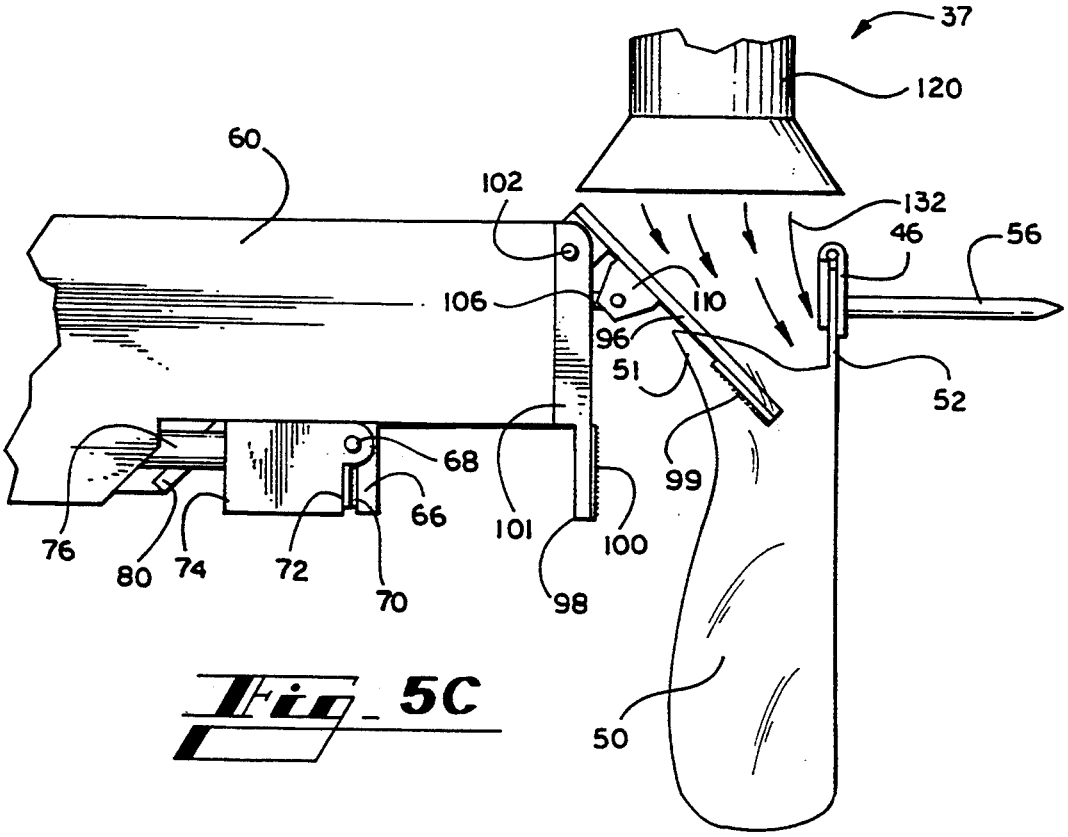
Figure 5D:
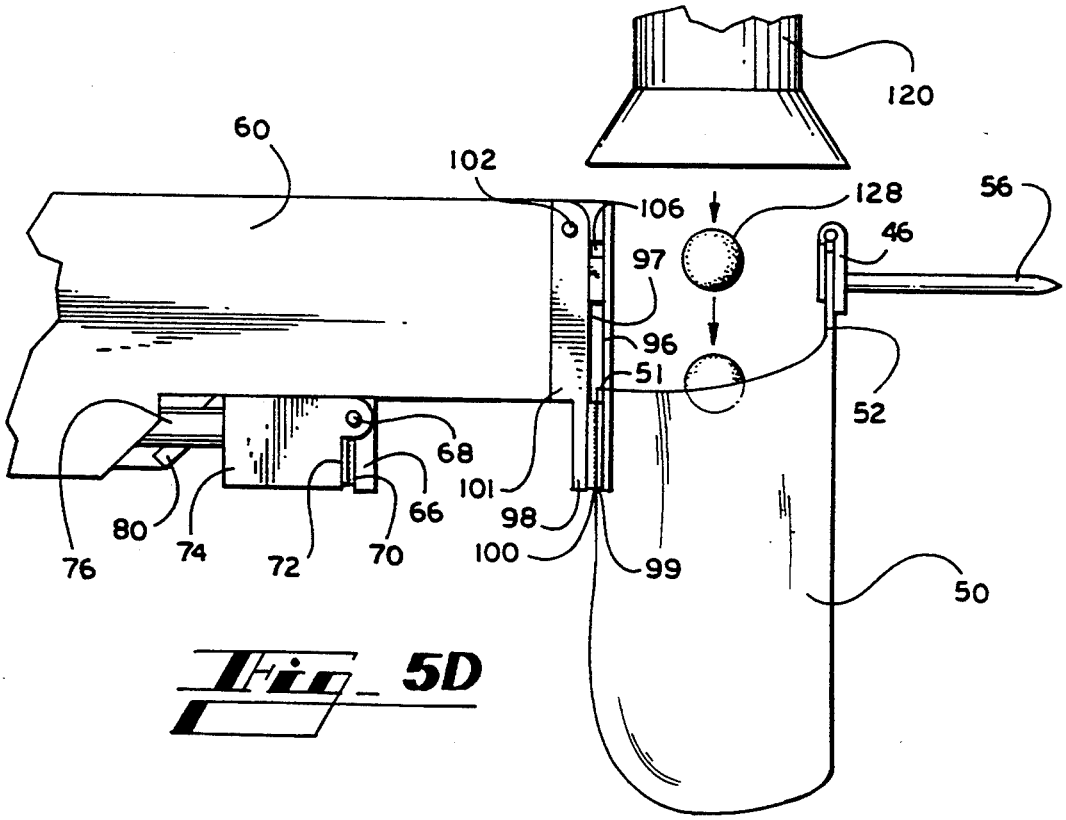

The function of the system 10 in view of the aforementioned structure will now be discussed. The initial positions of the bagging 5mechanism subassembly 34, the wicketed bag supply subassembly 32 and the product supply subassembly 37 in the system cycle are shown in FIG. 5A. Gripping jaw 66 is in a non-operative position on the guide shaft 76 during this stage of the cycle. The air cylinder 104 and piston rod 106 extend the pivotable plate 96 upwardly and outwardly toward the wicketed bag supply subassembly 32 at an angle between the vertical and the horizontal, preferably 35. Next, as shown in FIG. 5B, an intermittent blast of air 132 from the fan is directed through the air supply duct 130 into the duct 120. As the air 132 exits the mouth of the duct 120, the pivotable plate 96 guides the air into the mouth 54 of the bag 50, thereby opening the bag so that the lip 51 of the bag, opposite the lip 52 held by bag clamps 46, opens onto the outer edge of the pivotable plate 96. As the blast of air 132 fills the bag 50, the outer lip 51 of the bag 50 is forced around the outside edge of the pivotable plate 96 and into the space between the opened pivotable plate 96 and the stop plate 98, as shown in FIG. 5C. At the end of the blast of air 132 from the air supply duct 130, control circuitry well known to those skilled in the art (not shown) causes the cylinder 104 and the piston rod 106 to pivot the plate 96 downwardly away from the wicketed bag supply subassembly 32. As the pivotable plate 96 rotates downwardly, the inner surface of the plate containing the rubber gripping teeth 99 contacts the inner edge of the bag below to the bag lip 51. The cylinder 104 and piston rod 106 continue to rotate the pivotable plate 96 until the pivotable plate 96 presses against the stop plate 98 with the bag 50 securely held between the teeth 99 and 100 as shown in FIG. 5D.

Throughout the bagging process, the product 128 is supplied from the remote product supply 124 and is dispensed onto the conveyor 126, as shown in FIG. 2. The conveyor 126 carries the product 128 to the receiving funnel 122, into which the product 128 is dispensed. Through control technology well known to those skilled in the art, a supply gate 134, indicated in phantom in FIG. 2, within the duct 120 is opened at periodic intervals and allows a predetermined amount of product 128 to be dispensed into the duct 120. Each periodic interval corresponds to the end of the intermittent blast of air 132, during which the bag is clamped between the teeth 99 and 100 of the pivotable plate 96 and the stop plate 98.

As the product 128 is dispensed, the bag 50 is supported on two sides; the bag clamps 46 support the bag on one side corresponding to the bag lip 52, while the pivotable plate 96 and stop plate 98 support the second side corresponding to bag lip 51. The bag 50 is also supported underneath by the conveyor 40, on which the bottom of the bag 50 rests as it becomes filled with the product 128. This support allows a heavy product to be dispensed into the bag 50 without the bag 50 tearing away from or being pulled down from either the wicketed side or the clamped side. Further, the support on both sides of the bag 50 also allows the bag 50 to remain fully open after the intermittent blast of air 132 ceases, effectively allowing the product 128 to be dispensed into the bag 50 without the product 128 spilling over the sides of the bag 50. Alternatively, the bag 50 is positioned above the conveyor 40 so that the bag 50 is not supported by the conveyor as the product 128 is dispensed. Rather, the bag 50 is supported only on two sides and falls downwardly onto the conveyor 40 after the bag 50 is two away from the wicketed bag clamp subassembly 32, closed and released by the gripping jaw 66 in a manner set forth in detail below.

Figure 6C:
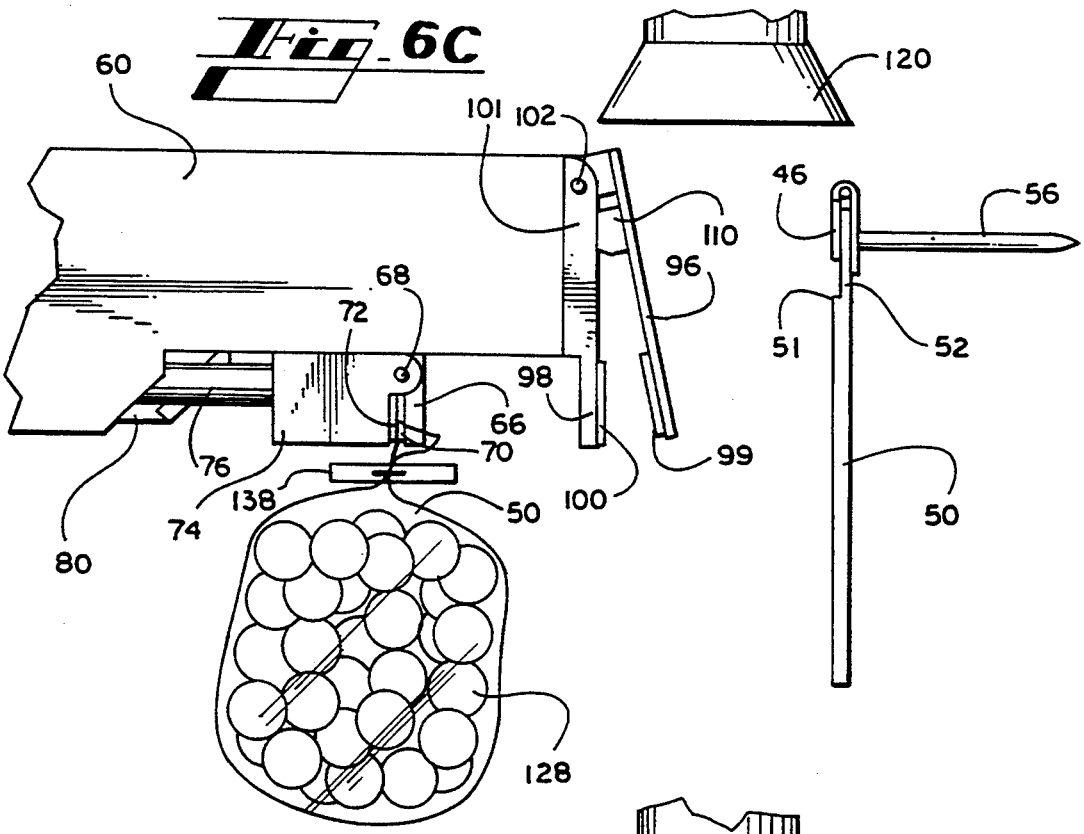
Figure 6D:
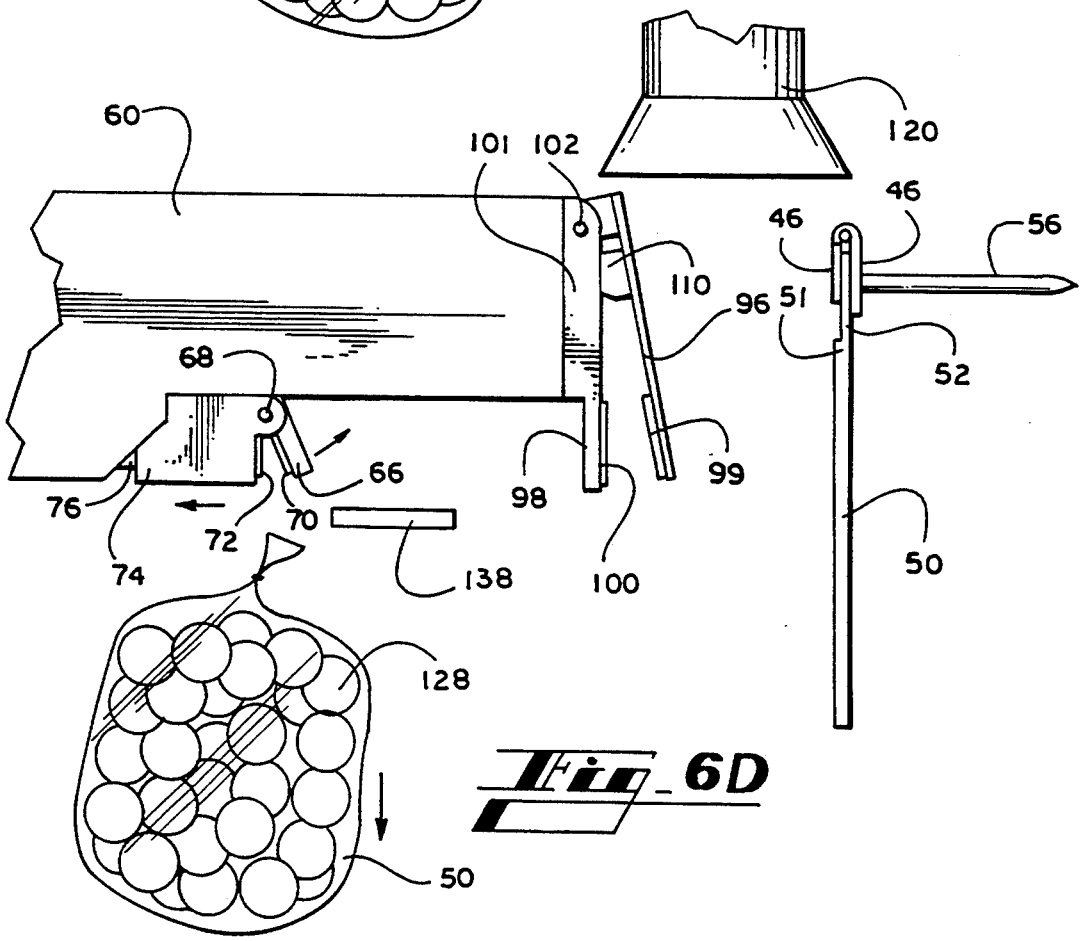

After the predetermined amount of product 128 is dispensed into the bag 50, the supply gate 134 closes within the duct 120 and the air cylinder 86 and piston rod 88, in response to control technology well known to those skilled in the art, move the jaw body 74 in a forward direction, with the jaw 66 extending through the plate opening 97, as shown in FIG. 6A. The gripping jaw 66 is horizontally positioned following the previous cycle in a manner set forth in detail below. When the front end of the jaw body 74 contacts the stop plate 98, the roller 82 contacts the stop plate 98, as shown in FIG. 4D, urging the jaw 66 into a position slightly below its initial horizontal position. This elevates the hinge 67 to a position in which leverage can be applied. Once the gripping jaw 66 is urged into this position, the air cylinder 64 causes the piston rod 65 to extend causing the jaw 66 to continue to pivot downwardly through the plate opening 97 and over the bag lip 51. Gripping jaw 66 thus secures the side of the bag 50 corresponding to the bag lip 51 between rubber gripping teeth 70 and 72 of the gripping jaw 66 and the jaw body 74. As the gripping jaw 66 and the jaw body 74 secure the bag 50, the air cylinder 104 and piston rod 106 pivot the pivotable plate 96 upwardly away from the stop plate 98, thereby releasing the bag 50, as shown in FIG. 6B. Next, the bag 50 is torn away from the wicketed bag supply clamps 46 as the air cylinder 86 and piston rod 88 move the jaw body 74 rearwardly in synchronous fashion along with the conveyor 40 toward the cam surface 80. As the gripping jaw 66, jaw body 74 and conveyor 40 move rearwardly, they transport the filled bag 50 through a bag closing mechanism 138. This bag closing mechanism can be of the type manufactured by the Quik Lok Corporation of Yakima, Washington and disclosed by Germunson, U.S. Pat. No. 3,822,527, which is incorporated herein by reference in its entirety, or of any other type well known to those skilled in the art. The top of the bag is tied or otherwise closed to contain the product 128 within the bag 50 as shown in FIG. 6C. The gripping jaw 66, jaw body 74 and conveyor 40 continue in a rearward direction with the closed bag 50 until the roller 82 of cam follower 84 contacts the cam surface 80. This contact begins to open the gripping jaw 66 outwardly away from the jaw body 74. Air cylinder 64 and piston rod 65 subsequently cause the gripping jaw 66 to open completely to the horizontal, thereby releasing the bag 50 and preparing the gripping jaw 66 for the next cycle in which another bag is filled. When the jaw 66 is horizontal, the cam follower 84 is positioned somewhat forward of vertical, as shown in phantom in FIG. 4E.

As the gripping jaw 66 is opened by the contact between the cam surface 80 and the cam follower 84, the closed bag 50 is released and continues to move on the conveyor 40. The conveyor 40 carries the bag 50 away from the bagging system 10 either to a remote area for temporary storage or directly to a specific mode of transportation for shipment of the bagged product.

It will thus be seen that, in the present invention, the initial blast of air opens the wicketed bag 50 through accurate guidance by the pivotable plate 96. Further, it will be seen that the pivotable plate 96 both fully opens the bag 50 to receive the product 128 and secures the bag 50 as the product 128 is dispensed. It will also be seen that the gripping jaw 66 and jaw body 74 tear the bag 50 away from the wickets 56 of the wicketed bag supply subassembly 32 after the product 128 is dispensed into the bag 50 through duct 120 and as the pivotable plate 96 releases the bag 50.

The timing and operation of the air cylinders 64, 86 and 104, the supply gate 134 and the conveyors 40 and 126 are controlled by a computer processor, which may be a programmed computer. The air cylinders are connected to a conventional pneumatic circuit (not shown) including appropriate electrically operated valves. Microprocessors of the type contained in readily available personal computers are capable of operating the apparatus when connected to appropriate valves and switches by conventional signal transmission lines. It is within the skill of a programmer of ordinary skill in the art to prepare computer programs to carry out the routines for operating the system described below and depicted in FIGS. 1 and 2, when provided with the present disclosure.

It will be understood that the preferred embodiment has been disclosed by way of example, and that other modifications may occur to those skilled in the art without departing from the scope and spirit of the appended claims.

We claim:

1. A method of automatically bagging a product, comprising the steps of:

providing at least one premade wicketed bag having a bag opening;

directing a flow of air toward the opening;

guiding air into the opening by positioning a horizontally pivotable plate extendible downwardly from a pivot at an angle to a first position where the far edge of the plate is adjacent to the wicketed bag to guide air from the flow of air into the opening of the wicketed bag;

moving the plate to a second position where the plate supportively clamps the wicketed bag on a first side, the wicketed bag being opened to receive a product as the product is dispensed, and agitating the product while dispensing the product to prevent the product from becoming jammed.

2. An apparatus for opening a bag in an automatic bagging system, comprising:

a holding mechanism for supporting at least one bag having a mouth and a first side in supported engagement with said holding mechanism;

an air supply;

a horizontally pivotable plate extendible downwardly from a pivot at an angle to a first position where an edge of said plate, spaced apart from said pivot, is adjacent to the bag, said plate in said first position being oriented to guide air from said air supply into the mouth of the bag, said plate being movable to a second position where said plate extends farther downwardly and into the bag to support the mouth of the bag for loading and to support a second side of the bag;

an actuator mechanism operable to move said pivotable plate from said first position to said second position; and a conveyor disposed beneath the bag and in engagement therewith to support the bag while a product supply fills the bag with a product, said conveyor being operative to move the bag filled with the product to a bag closer.

3. The apparatus of claim 2, further comprising a bag clamp for clamping the first side of the bag to said holding mechanism, said bag clamp providing further support to the bag.

4. The apparatus of claim 2, further comprising a process slide including a gripping jaw for gripping and tearing away said bag after said bag is filled with a product.

5. The apparatus of claim 4, wherein said process slide comprises at least one air cylinder, a linear bearing and a guide shaft.

6. The apparatus of claim 2, further comprising a bag closer operative to close said bag filled with the product.

7. The apparatus of claim 2, further comprising a product supply operative to fill said bag with the product.

8. The apparatus of claim 2, further comprising a stop, the second side of the bag being clamped between said plate and said stop when said plate is in said second position.

9. The apparatus of claim 8, wherein a clamping side of said plate and said stop comprises a rubber gripping coating.

10. The apparatus of claim 2, wherein said conveyor operates synchronously with said plate.

11. The apparatus of claim 2 further comprising an agitator to keep said product supply from jamming with the product.

12. The apparatus of claim 2, wherein said air supply comprises a fan.

13. The apparatus of claim 2, wherein said holding mechanism comprises a wicket capable of holding a plurality of bags.

14. An apparatus for opening a bag in an automatic bagging system, comprising:

a holding mechanism for holding at least one bag having a mouth and a first side supported by said holding mechanism;

an air supply;

a horizontally pivotable plate extendible downwardly from a pivot at an angle to a first position where an edge of said plate, spaced apart from said pivot, is adjacent to the bag, said plate in said first position being oriented to guide air from said air supply into the mouth of the bag, said plate being movable to a second position where said plate extends farther downwardly and into the bag to support the mouth of the bag for loading and to support a second side of the bag:

an actuator mechanism operable to move said pivotable plate from said first position to said second position; and a stop operatively associated with said plate, the second side of the bag being clampable between said plate and said stop when said plate is in said second position.

wherein a clamping side of said plate and said stop comprises a rubber gripping coating.

15. A method for automatically bagging a product, comprising the steps of:

providing at least one premade wicketed bag having a bag opening;

directing a flow of air toward the bag opening;

guiding air into the bag opening by positioning a horizontally pivotable plate extendible downwardly from a pivot at an angle to a first position where the far edge of the plate is adjacent to the wicketed bag to guide air from the flow of air into the wicketed bag opening;

moving the plate to a second position where the plate supportively clamps the wicketed bag on a first side, the wicketed bag being opened to receive a product as the product is dispensed;

filling the wicketed bag with a product; and supporting the wicketed bag on a conveyor while the wicketed bag is being filled.

16. The method of claim 15, wherein said step of moving said plate to a second position comprises moving said plate so that said plate clamps said bag between said plate and a stop.

17. The method of claim 15, wherein said step of moving said plate to a second position comprises moving said plate so that said plate clamps said bag on a non-wicketed side of said bag.

18. The method of claim 15, further comprising the step of clamping a second wicketed side of said bag with a bag clamp.

19. The method of claim 15, wherein said step of directing a flow of air comprises directing a flow of air from a fan.

20. The method of claim 15, further comprising the step of agitating the product while dispensing the product to prevent the product from becoming jammed.

21. The method of claim 15, further comprising the step of conveying the wicketed bag containing the dispensed product to a bag closing location.

22. The method of claim 21, wherein said step of conveying operates synchronously with said step of moving the plate between the first and second positions.

23. An apparatus for opening, filling and closing bags of a wicketed bag supply supported by said apparatus, comprising:

an air blower for opening one bag of the wicketed bag supply;

a front bag clamp for holding a front portion of the bag as the bag is opened;

a rear bag clamp and stop assembly comprising a rear bag clamp and a cooperating stop, mounted adjacent to the wicketed bag supply, said rear bag clamp being pivotable to a first position to guide air from said air blower into the bag, and to a second position to secure a rear portion of the bag to said stop;

a dispensing mechanism, said dispensing mechanism operative to supply a product to the open bag;

a conveyor disposed beneath the open bag and in engagement therewith to support the bag while a product supply fills the open bag with said product and wherein said conveyor is operative to move the open bag filled with the product from a product supply to a bag closer;

a process slide mounted for movement away from the wicketed bag supply and comprising a gripping member, wherein said gripping member grasps the open bag and said process slide pulls the open bag from the wicketed bag supply; and a bag closer operative to close the open bag as said process slide pulls the open bag from the wicketed bag supply.

24. An apparatus for opening a bag in an automatic bagging system, comprising:

a holding mechanism for holding at least one bag having a mouth and a first side supported by said holding mechanism;

an air supply;

a horizontally pivotable plate extendible downwardly from a pivot at an angle to a first position where an edge of said plate, spaced apart from said pivot, is adjacent to the bag, said plate in said first position being oriented to guide air from said air supply into the mouth of the bag, said plate being movable to a second position where said plate extends farther downwardly and into the bag to support the mouth of the bag for loading and to support a second side of the bag;

an actuator mechanism operable to move said pivotable plate from said first position to said second position;

a product supply operative to fill the bag with the product; and an agitator to keep said product supply from jamming with the product.

25. An apparatus for opening a bag in an automatic bagging system, comprising:

a holding mechanism for supporting at least one bag having a mouth and a first side in supported engagement with said holding mechanism;

an air supply;

a horizontally pivotable plate extendible downwardly from a pivot at an angle to a first position where an edge of said plate, spaced apart from said pivot, is adjacent to the bag, said plate in said first position being oriented to guide air from said air supply into the mouth of the bag, said plate being movable to a second position where said plate extends farther downwardly and into the bag to support the mouth of the bag for loading and to support a second side of the bag;

an actuator mechanism operable to move said pivotable plate from said first position to said second position; and a stop, the second side of the bag being clamped between said plate and said stop when said plate is in said second position.

* * * * *